United States Patent [19]

Womack

[11] 4,097,218

[45] Jun. 27, 1978

[54] MEANS AND METHOD FOR CONTROLLING EXCESS AIR INFLOW

[75] Inventor: John W. Womack, Princeton, N.J.

[73] Assignee: Mobil Oil Corporation, New York, N.Y.

[21] Appl. No.: 740,325

[22] Filed: Nov. 9, 1976

[51] Int. Cl.[2] ..... F23H 1/02

[52] U.S. Cl. ..... 431/76; 236/15 E

[58] Field of Search ..... 431/2, 12, 90, 76; 236/14, 15 E

[56] References Cited

U.S. PATENT DOCUMENTS

| | | | |
|---|---|---|---|
| 3,049,300 | 8/1962 | Lewis et al. | 431/76 X |
| 3,241,597 | 3/1966 | Juzi | 431/76 X |
| 3,602,487 | 8/1971 | Johnson | 431/76 X |
| 3,616,274 | 10/1971 | Eddy | 431/76 X |
| 3,722,811 | 3/1973 | Osburn | 236/14 |

*Primary Examiner*—Edward G. Favors

*Attorney, Agent, or Firm*—Charles A. Huggett; Michael G. Gilman

[57] ABSTRACT

A regulation system for adjusting the influx of air to a combustion zone in which an off-gas and one or more auxiliary fuels are burned. Manifestations of the composition and mass flow rates of the various fuels flowing to the combustion zone are applied to the control system. The system accommodates the signals and determines the molar proportions of the fuel components. It further determines the molar flow rate of oxygen which is theoretically necessary for complete combustion. A representation of a desired amount of excess air is then factored in and a representation of the proportion of molecular oxygen which will appear in the combustion products for the desired excess air percentage. The latter factor is used to determine the setpoint in a control loop whereby the fuel/air ratio is maintained in accordance with an output from an oxygen-sensing transducer in the flue which receives the combustion products.

11 Claims, 8 Drawing Figures

% O
100
98
$T_0(K)$
I
90
96
K
94
T0
64
$I_{co}$
102
P
62
63
76
78
70
71
72
60
61
80
82
66
68
FUEL GAS COMP. 1
FUEL GAS FLOW
FUEL GAS COMP. n
FUEL OIL FLOW
OFF GAS FLOW
OFF GAS COMP.
OFF GAS INERTS

MEANS AND METHOD FOR CONTROLLING EXCESS AIR INFLOW

BACKGROUND OF THE INVENTION

The present invention relates to combustion systems using low heating value gases, and more particularly to a regulation system therefor which modifies a feedback loop setpoint in order to effect a flow of a predetermined percentage of excess air to the combustion zone.

In practicing many industrial processes, waste products are given off which are combustible and thus have an energy content which may be used to advantage. In steel mills and petroleum refineries, for example, combustible waste gases are produced which can be recycled and burned to produce heat energy for use in the mill or refinery. In addition to their combustible or heating value such gases additionally are commonly produced at a higher temperature, and thus contain a sensible heat energy which may also be made use of.

In the past apparatus have been constructed especially for making use of the sensible heat and the heating value of by-product or off-gases. Often the apparatus takes the form of a boiler for raising steam, which is piped to appropriate locations in a factory or refinery wherein heat energy is needed. Economics dictates that boilers so constructed be large enough to supply the anticipated demand for steam and to burn the maximum flow of off-gas. Auxiliary fuel is supplied to these boilers in amounts sufficient for the proper combustion of the off-gas. Further as the demand for steam may vary considerably and rapidly, while the production of waste gases is often fairly constant, auxiliary fuel streams are often controlled to provide a peak load or "swing" capability. In this manner the relatively constant flow of off-gas is supplanted by conventional fuels, such as natural gas and/or fuel oil, whose flows can be varied to increase or decrease the steam flow rate from the boiler.

In accordance with state of the art practice, control systems are provided for the boilers to control the volume of air pumped into the combustion zone wherein the fuels are burned. Such systems conventionally include a transducer associated with the stack or flue for monitoring the percent of molecular oxygen in the combustion products as they exit through the flue. Also in accordance with state of the art practice, a setpoint is established in the control system whereby a given percentage of oxygen in flue gases is taken to be representative of the proportion of excess air flowing to the combustion zone.

Studies by the present inventor have revealed that the amount of air which is required for satisfactory combustion varies drastically with the proportion of low heating value gas in the total fuel stream, and further with the degree of dilution of the waste gas by inert components. This, despite the fact that the inert components do not themselves combine with any oxygen. When insufficient excess air is supplied to the combustion zone, some of the fuel is not burned and raw fuel is discharged into the atmosphere. Conversely, if too much excess air is provided the air uselessly traverses the combustion zone and carries useful heat out through the flue. The inventor's studies have further disclosed that a fixed percentage of molecular oxygen in the combustion products does not necessarily correspond to a constant rate of excess air inflow to the combustion zone, as had previously been assumed. In fact, a constant "target" fraction of molecular oxygen in the combustion products will not accommodate changes in the fraction of low heating value gases used, nor the degree of dilution of these gases, without a loss in boiler efficiency.

Accordingly, it will be understood that it would be highly desirable to provide a system for making use of the heating value of waste or off-gases, and which operates economically even in the presence of wide variations in overall fuel composition, using neither too much nor too little excess air. Accordingly, it is an object of the present invention to provide an improved combustion system for waste gas products.

Another object of the invention is to maintain a predetermined inflow of excess air to a combustion zone in the presence of variations in fuel flows to the combustion zone.

Still another object is to introduce an optimum percentage of excess air to the combustion zone as fuel flow or composition varies.

Another object is to conserve the auxiliary fuels which are burned along with waste gases.

Yet another object is to provide a supervisory control system for a by-product gas combustion system which maintains a flow of low polluting combustion products.

SUMMARY OF THE INVENTION

Briefly stated, in accordance with one aspect of the invention the foregoing objects are achieved by continuously sensing flow rates of the various fuels supplied to a combustion zone, and analyzing the composition of at least some of the fuels. A supervisory control receives fuel stream flow and composition information, determining the molar proportions of the fuels and associating therewith the requisite molar proportions of oxygen representing complete combustion of the fuel constituents. Signals representing the latter constituents are utilized by an oxygen target stage which develops an indication of the proportion of molecular oxygen in the exhaust products corresponding to a predetermined excess air inflow, and this information is used to vary the setpoint in a control loop including a stack oxygen sensor so that the fuel/air ratio is varied to maintain the requisite percentage of excess air to the combustion zone.

BRIEF DESCRIPTION OF THE DRAWINGS

While the specification concludes with claims particularly pointing out and distinctly claiming the subject matter which is regarded as the invention, it is believed that the invention will be better understood from the following description of a preferred embodiment taken in conjunction with the accompanying drawings in which:

DESCRIPTION OF A PREFERRED EMBODIMENT

Figure 1:
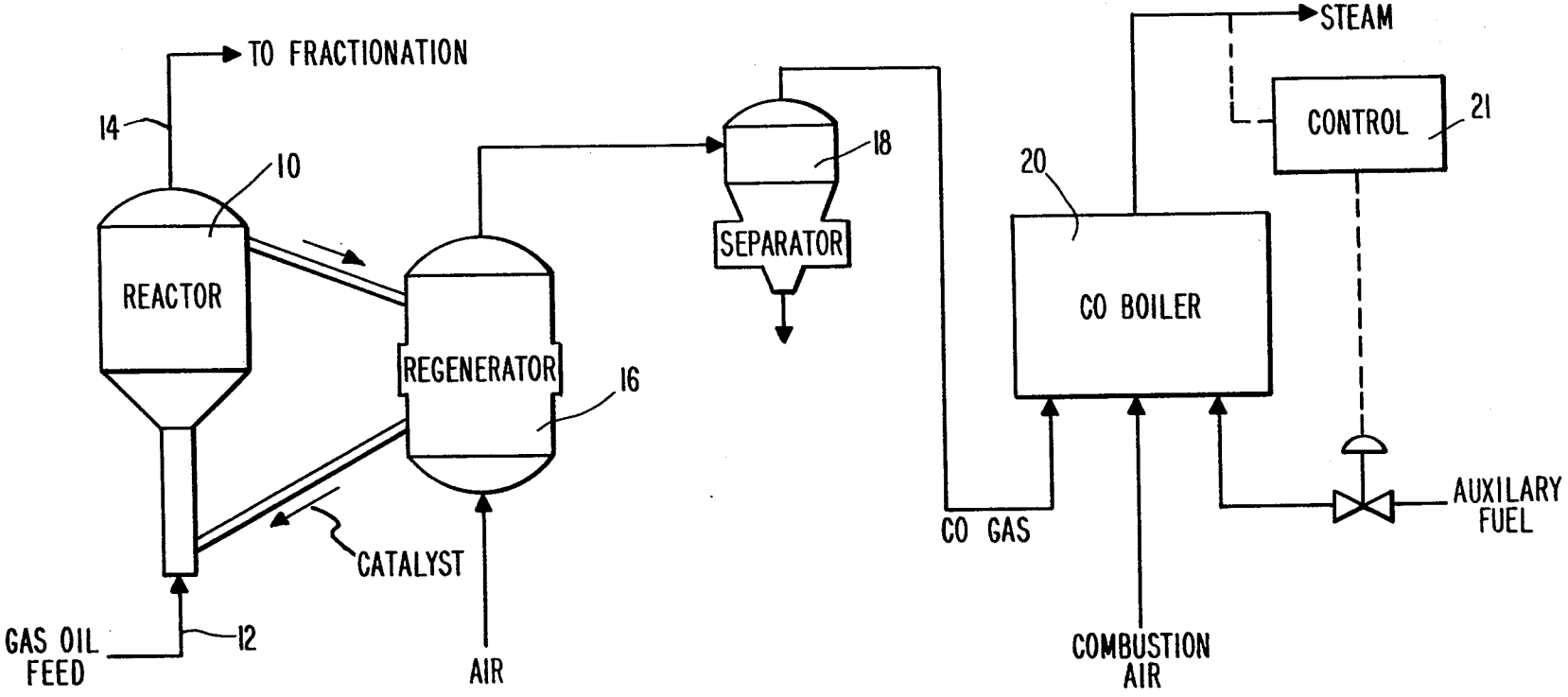
Fig. 1 PRIOR ART
FIG. 1 is an idealized diagram showing a simplified arrangement of an off-gas utilization system in a petroleum refinery.

FIG. 1 depicts a simplified arrangement wherein waste gas which occurs as a by-product in a petroleum refinery is collected and made use of. A reactor 10 comprises a vessel in which a gas oil feed stock undergoes cracking in order to improve the octane rating thereof. As shown, the gas oil stream 12 is fed into the lower part of the reactor. Within the reactor the feed stock is brought into contact with a fluidized catalyst of an appropriate type. Inasmuch as catalytic cracking techniques and apparatus are well known in the refining art, and moreover form no part of the present invention, the cracking process and apparatus will not be discussed in detail. For present purposes it will suffice to say that the feed stock is brought into intimate contact with the catalyst under pressures and temperatures calculated to optimize the cracking process.

The cracked feed products exit from the uppermost part of the reactor in stream 14, whereupon they are passed to fractionation or other appropriate equipment for further processing. As a consequence of the cracking process occurring within reactor 10, carbon is deposited upon the catalyst. By keeping the feed stock from contact with the catalytic material the carbon coating serves to reduce the effectiveness of the catalyst. Owing to the expensive nature of the catalyst, it is necessary to rejuvenate or re-activate the catalytic material so that it can be used repeatedly. To accomplish this the catalyst is ordinarily conveyed from the reactor to a regenerator 16, then re-conveyed to the reactor where it is used once more. This procedure may occur periodically or continuously, depending upon the design of the overall system.

Within regenerator 16 the accumulated carbon is removed from the catalyst by burning the catalyst in the presence of the carefully controlled quantity of air in order to avoid overheating, and thus permanently damaging, the catalyst. The combustion of the carbon, however, is incomplete so that the effluent from the regeneration process comprises a mixture of both carbon monoxide and carbon dioxide.

The resulting combustion products are passed through a separator 18 wherein particulate matter is removed. After separation the off-gas is transferred to a waste heat utilization means where the carbon monoxide is burned. In the present system the utilization means is depicted as a CO (for carbon monoxide) boiler 20. Within the combustion zone of boiler 20 the off-gas is mixed with an appropriate amount of air for combustion, and further with a variable quantity of a fuel which exhibits a high heating value as compared with the off-gas produced by regenerator 16.

While the terms "high heating value" and "low heating value" are relative and thus elude precise definition, waste or off-gases of the type under consideration are described as having a "low" heating value inasmuch as they wxhibit a far lower calorific value than do those materials which are commonly used as fuels. The more common fuel materials, some of which may be selected for use as auxiliary fuels in the illustrated waste gas utilization system, comprise natural gas, synthetic gas, fuel oils, and the like. The combined heat energy of the by-product (or waste) and auxiliary gases, along with the sensible heat energy attributable to the temperature of the incoming waste gas, is however sufficient to generate steam within a boiler and thus to derive useful energy from an otherwise-unproductive by-product. The steam may then be used to provide energy to heat buildings, or to support other industrial processes within the refinery.

In a system such as the one disclosed it is obviously necessary to operate the CO boiler at at least some minimum level at which all of the waste gas is burned. It is common practice to add one or more auxiliary fuels of relatively high heating value to ensure the complete combustion of all of the waste gas. In some cases, for instance in certain oil refinery applications, to avoid the uneconomical duplication of equipment boiler 20 is made large enough to produce considerably more steam than is obtainable from combustion of the waste gas alone. The heat required at the various sites to which the steam from the boiler is transmitted, however, often fluctuates substantially. In order to burn all of the waste gas and yet provide a variable total heat output, the flow of the auxiliary fuel is varied in accordance with the demand for heat, or in the present case, steam. To this end an auxiliary fuel control 21 is provided for maintaining the outputted steam at the requisite pressure, controlling the flow of the auxiliary fuel automatically as dictated by the amount of steam required.

Figure 2:
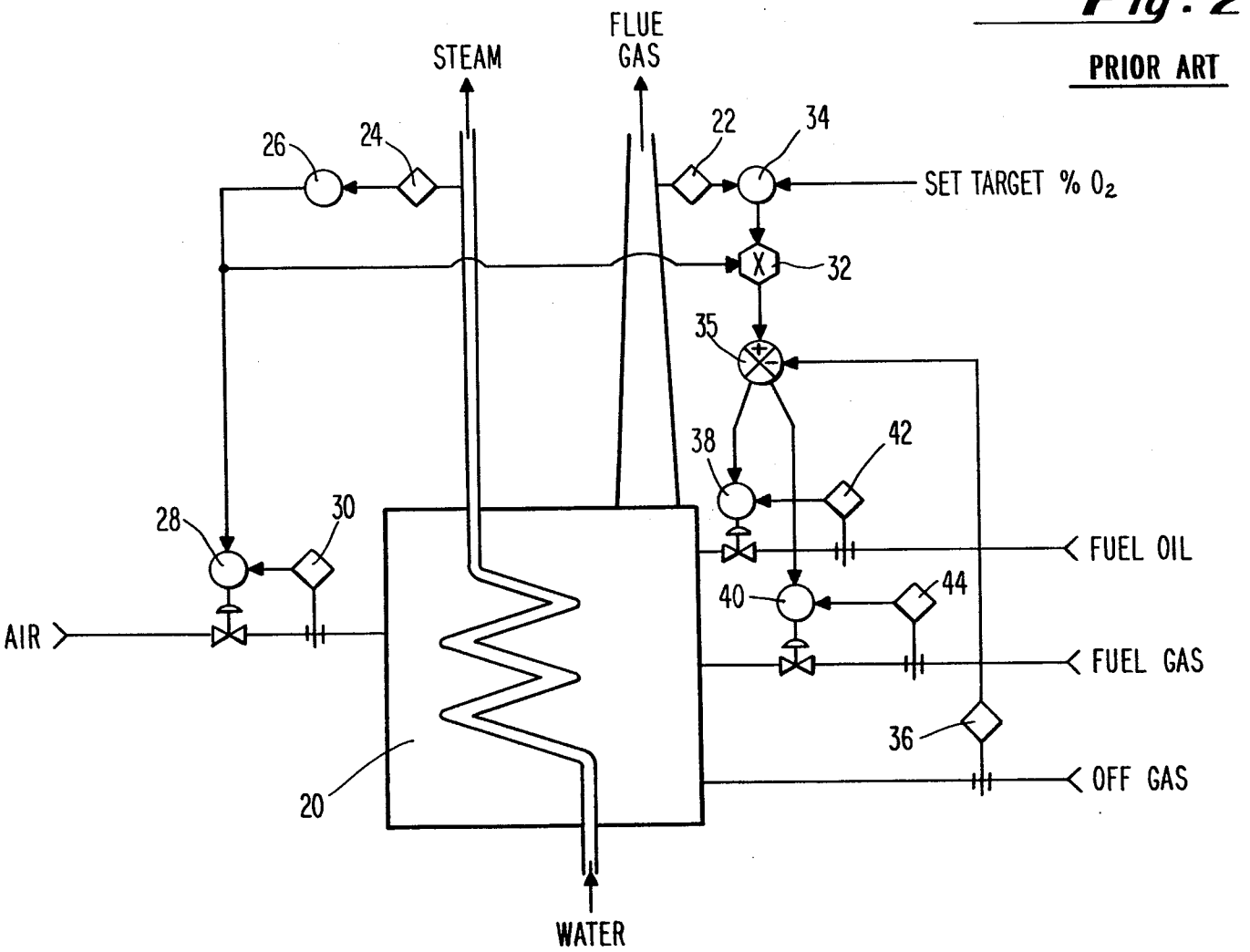
Fig. 2 PRIOR ART
FIG. 2 is a schematic diagram illustrating a prior art control system used in conjunction with a waste gas combustion system.

FIG. 2 depicts in further detail a prior art control system of a type typically used with the by-product gas utilization system of FIG. 1. The pressure of the steam exiting from boiler 20 is monitored by a pressure sensing transducer 24. Controller 26 outputs a signal which controls air flow to the combustion zone of the boiler by means of an air flow controller 28. Flow controller 28 may be any appropriate controlling mechanism, but in a preferred embodiment comprises a commercially available process controller. A flow transducer 30, herein illustrated as being of the differential pressure type, supplies air flow information to controller 28. Controller 28, like the other controllers depicted in connection with the preferred embodiments, may be a model TL101 process controller obtainable from the Fisher Instrument Co. of Marshaltown, Iowa.

Controller 26 also supplies a signal to fuel flow controllers 38, 40 by way of a multiplier 32 and summing node 35. The output of node 35 reflects not only the fuel demand signal from multiplier 32, but also the flow of byproduct gas. The latter value is derived by a flow transducer 36; the flow of auxiliary fuel is determined by transducers 42, 44.

Multiplier 32 comprises a ratio stage and imposes a desired fuel/air ratio which is determined by the signal from controller 34. In this manner more or less auxiliary fuel is caused to be supplied, as needed, to maintain the desired steam pressure in the presence of varying demands for steam. The ratio stage 32 comprises a multiplier such as a model TL172 multiplier-divider obtainable from the Fisher Instrument Co. The multiplier receives a signal from a controller 26, and also a signal from controller 34 which reflects the difference (error) between a preselected setpoint and the output of transducer 22.

The latter transducer is an oxygen sensor of the zirconium oxide type, and outputs an electrical signal which represents the percentage of molecular oxygen in the flue gases of the system. This signal is compared in controller 34 with a setpoint signal which represents the desired or "target" percentage of oxygen in the flue gases.

The ratio stage outputs a fuel demand signal calling for an increase or decrease in the flow rate of one or more of the auxiliary fuels to compensate for the change in air flow. A summing node 35 processes the demand signal to allow for the flow of off-gas, as evidenced by the output of flow transducer 36. The final, demand signal is then applied to one or more flow controllers 38, 40 to modify the flow rates of auxiliary fuel oil and gas, respectively. The latter flow controllers are served by flow transducers 42, 44 so that the necessary feedback is provided.

As will now be apparent to those skilled in the art, a cross coupling (lead-lag) system is preferably used with the depicted apparatus. Such systems are entirely conventional and are commonly utilized to prevent the fuel/air mixture from becoming overrich under transient demand conditions. The cross coupling system serves to compensate for disparities in the response times of the fuel and air delivery systems. Inasmuch as these systems are well known and form no part of the present invention they are not represented in the Figures Turning now to FIG. 3 there is shown an improved system making use of the teachings of the present invention, and which effectively supplants prior art systems like that of FIG. 2. As before the demand for steam is reflected in the pressure of the stream, producing a signal which is transmitted through a pressure transducer 24 to controller 26. In response to the thus-produced signal the air flow controller 28 increases the air supply to the boiler 20, and controllers 38, 40 increase the flow of auxiliary fuels proportionally. Under the new conditions molecular oxygen in the flue gases will ordinarily change somewhat. This change is sensed by controller 34, which applies a setpoint signal to ratio station 32. The latter signal is combined with the signal from controller 26 to effect a change in the flow of the auxiliary fuels as described with respect to FIG. 2.

Figure 3:
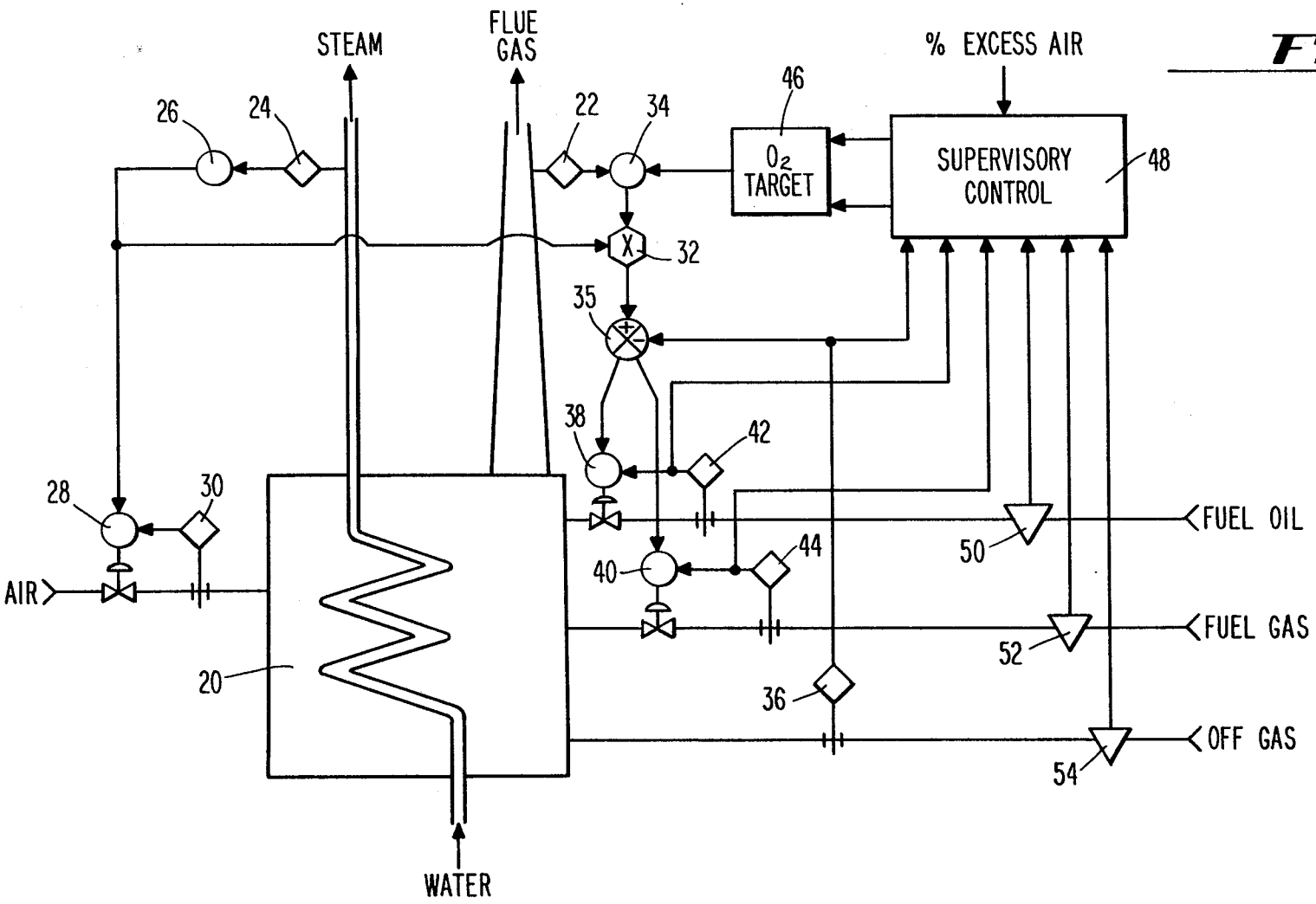
FIG. 3 is an illustration of a waste gas combustion system and controls according to one embodiment of the present invention.

With the embodiment of FIG. 3 the target input to controller 34 is produced by an oxygen target stage 46. The latter stage, along with a supervisory control 48, forms a regulator which varies the target oxygen value as changes occur in the total fuel stream flowing into the combustion zone.

In order to monitor the fuel streams, outputs from flow transducers 42, 44 and 36 are applied to control 48. Further, composition analyzers 50, 52 and 54 are provided for determining the proportion of various constituents of the auxiliary fuel oil and gas and the off-gas streams, respectively. While in a preferred embodiment a separate analyzer is assigned to each fuel stream, it is recognized that economy may dictate the use of fewer analyzers. In principle a single analyzer might be adapted for use with the present system, sampling each fuel stream at appropriate intervals. Further, for applications wherein fuel composition changes insubstantially or relatively infrequently it may be practical to have fuel samples analyzed at some remote location and introduce the composition information into the supervisory control by means of manually operated adjustments.

In the preferred embodiment composition analyzer 50 is constituted by a densitometer, while analyzers 52 and 54 are gas chromatographs. No particular model of chromatographs need be used and it is anticipated that many of the commercially available units can be utilized in connection with the described embodiments.

The inventor's studies have shown that the composition of the waste gas in particular varies considerably, and in order to obtain maximum efficiency from the present system compensation therefore should be made. Often, however, the composition is predictable and appropriate system parameters can be manually varied to suit. Where auxiliary fuel gases are used which result from ongoing processes, such as is the case in a refinery, the composition of the gas may change from time to time. In such a case also it is preferable to provide an analyzing mechanism in communication with the fuel stream.

The inventor has found, however, that even substantial deviations in the composition of the auxiliary fuels do not have as severe an effect upon the measured variable (flue gas oxygen) as do changes in the percentage of auxiliary fuel in the total fuel stream. For this reason, it is important to the successful implementation of the invention that changes in the ratio of off-gas to auxiliary fuel be determined and compensated for.

While the fuel flow transducers may be of any appropriate design, however, the net output signals preferably should reflect the mass rate of flow of a given fuel stream rather than merely the volume rate of flow. In this vein purely volumetric instrumentation may be used in conjunction with appropriate corrections for taking into account changes in pressure and temperature which affect the nominal volume of the fuel.

The supervisory control 48 then combines the various inputs representing fuel composition and mass flow in order to determine the molar proportions of the fuels. This procedure is straightforward, requiring that the molecular weights of the previously-identified materials be associated with the materials so that the molar fractions of the various fuels are established. Signals representing the molar fractions of the fuel materials are then processed to determine the total combustion product, that is, the identity and molar proportion of the compounds which result from the complete oxidation of the fuels. As in the preceding step this is a straightforward process in which a value representing the requisite amount of oxygen is associated with the oxidizable fuel materials. This allows the total (theroretical) amount of oxygen needed for combustion to be determined and expressed in terms of a precentage or fraction of fuel flow.

A signal representing the molar fraction of oxygen required for complete combustion is then transmitted to oxygen target stage 46. The target stage determines the percentage of molecular oxygen which will occur in the combustion products when the desired percentage of excess air is supplied to the combustion zone, allowing for the presence of inert substances. Target stage 46 then outputs a target signal to controller 34 which comprises a setpoint for the controller.

If the actual oxygen percentage measured by transducer 22 is higher or lower than the desired target the difference will be reflected in changes in the setpoint signal fed back from controller 34. Ratio station 32 will then be caused to modify the fuel/air ratio so as to cause the percentage of oxygen in the flue gases to approach the desired value.

Until now, systems of the type depicted in FIGS. 1 and 2 have conventionally been operated through ratio controls in order to maintain a fixed proportion of molecular oxygen in the flue gases (exhaust products). The present inventor has determined that changes in the proportion of waste gas to auxiliary fuels often require drastic variations in the percentage of excess air in order that the proportion of molecular oxygen in the combustion products remains constant. Conversely, for a fixed proportion of molecular oxygen in the flue gases, either more or less excess air must be supplied to the combustion zone when changes in the apportionment between waste gas and auxiliary fuel occur. Until now, it had been assumed that such changes were relatively insignificant, and that by maintaining a fixed "target" proportion of oxygen in flue gases, the amount of excess air being introduced into the combustion zone would also remain substantially constant. The inventor of the present method and apparatus, however, has determined that this assumption is fallacious to the extent that changes in the mix of fuels supplied to the combustion zone cause very significant changes in the relationship between excess air supply and the proportion of oxygen in the combustion product.

It has been found that fluctuations in the composition of individual auxiliary fuel streams, while having a bearing upon the nature of the exhaust product, do not have as severe an effect as do changes in the proportioning of waste gas to auxiliary fuels. In addition, it has been found that the composition of the waste gas, and more particularly the amount of inert material therein such as nitrogen or carbon dioxide, has a substantial effect upon the relationship between the excess air supplied and the molecular oxygen which is vented through the flue. This is true even though the inert materials do not themselves interact with oxygen and despite the relatively low heating value of the waste gas. In view of the foregoing, it will now be understood that apparatus such as that shown in FIG. 3 may be used to vary the fuel/air ratio in order to obtain any desired proportion of oxygen in combustion product. More importantly, the apparatus operates to modify the desired setpoint value of flue gas oxygen content so that a predetermined percentage of excess air can be supplied to the combustion zone at all times, despite changes in the apportionment of the fuels being burned.

As stated above, a common target value for excess air is 20%. In other words, the combustion zone is supplied with 120% of the air theoretically needed to fully burn all of the fuel. In order to monitor the ongoing combustion process, the molecular oxygen in the combustion products is determined by a transducer. The present invention is based upon the fact that an amount of flue oxygen which indicates a desired excess air percentage for one combination of fuels, may denote an entirely different excess air percentage when the fuel mix is changed. In one boiler system which was studied the waste gas comprised dilute carbon monoxide while the auxiliary fuel used was refinery gas, a fuel similar to natural gas. When 65% of the heating value was contributed by the waste gas, a flue gas oxygen content of 1.83% occurred when 30% excess air was used. When only 40% of the system heat was contributed by waste gas, however, the same flue gas figure of 1.83% corresponded to the presence of 20% excess air. Accordingly, by attempting to maintain a fixed level of oxygen in the flue gases, the excess air percentage is forced to fluctuate greatly when changes in the mix of auxiliary and waste gas fuels occur. The present invention recognized this phenomenon and compensates for the changes in fuel makeup, providing new target setpoints for flue gas oxygen as fuel composition changes.

It is always necessary to introduce some amount of excess air to the combustion zone. Due to the inevitably imperfect mixing of fuel and air, it is necessary to provide excess air in order to assure that the fuels are completely burned. If only the theoretical minimum amount of air were supplied to the combustion zone not all of the fuel would be burned, and some unburned fuel would escape in the combustion products in the form of atmospheric pollutants. Hence, and in order to achieve complete combustion, it is necessary that some amount of air in an excess of the theoretical minimum be supplied to the combustion zone. Conventionally fixed value, for instance 20%, is used although a higher or a lower figure could be selected depending upon the particular combustion process, the efficiency of the fuel/air mixing taking place in the combustion zone, and other system variables.

What is not so apparent is the detrimental effect of the excess air. While too much air serves to minimize pollutants by fully burning all of the fuel which is supplied to the combustion zone, unburned excess air is merely heated by the combustion process and discharged through the flue with the combustion products. The excess air thus absorbs heat and carries it out of the heat exchange system, dissipating the heat in the atmosphere and wasting it. Accordingly, some percentage of the heat energy attributable to the combustion process is wasted in raising the temperature of excess air. For this reason it will be appreciated that it is undesirable to provide more excess air than is necessary to achieve complete combustion of the fuels used.

Figure 4:
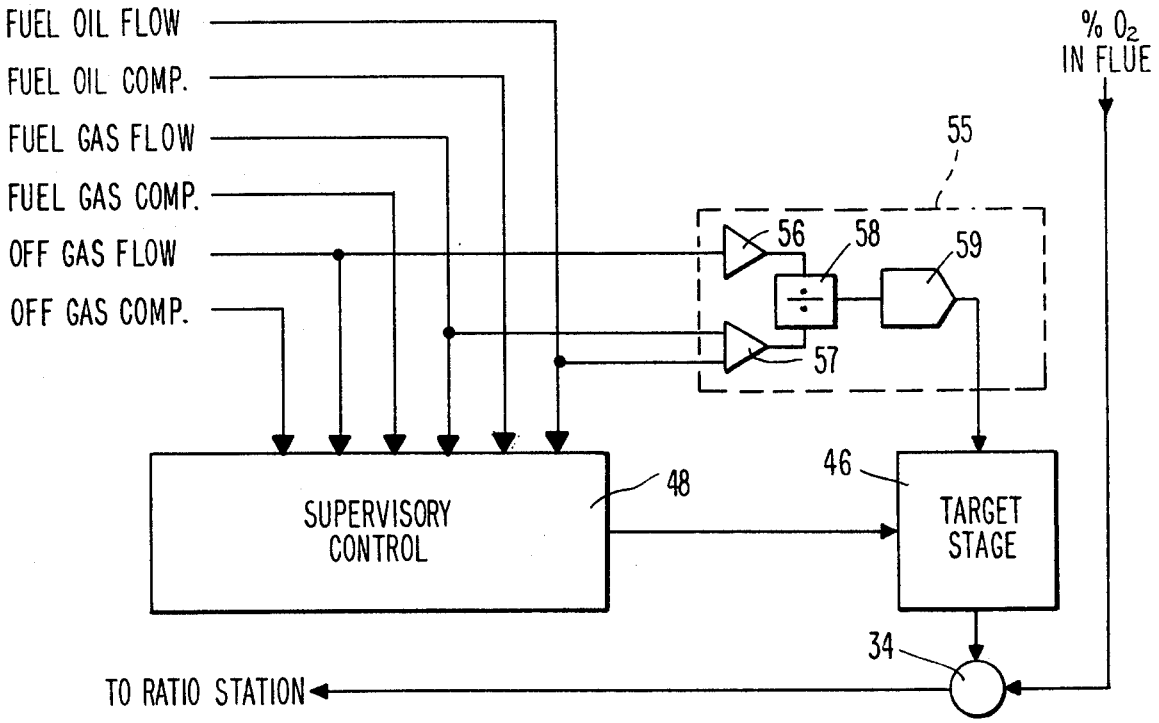
FIG. 4 is a modified embodiment of the regulation system of FIG. 3.

In order to maximize the efficiency of the depicted system, the excess air setpoint may be automatically varied with changes in the nature of the total fuel stream. A system adapted to provide such automatic adjustment is shown in FIG. 4. Instead of a fixed or manually adjusted setpoint the target stage 46 receives an excess air signal from a setpoint controller 55 which is coupled to one or more of the fuel streams. In this manner the percentage of excess air may be varied when the mass flow rate and/or composition of the fuels change. In a preferred embodiment, setpoint controller 55 comprises first and second amplifiers 56, 57. In the disclosed embodiment the amplifiers are supplied with signals reflecting the flow rates of the off-gas and auxiliary fuels, respectively. The amplifiers are coupled to an appropriate analog divider stage 58 which derives the effective ratio between the fuel flow rates. A signal representing the off-gas to auxiliary fuel ratio is then applied to function generator 59 which outputs an appropriate "excess air" signal to oxygen target stage 46. As a result, the target signal produced by stage 46 is caused to vary the actual percentage of excess air required by the control system.

A more elaborate, and accordingly more accurate setpoint control may be constructed which also takes into account changes in fuel composition. This can be accomplished by adding appropriate amplifiers and proportioning circuits to the setpont control, and coupling them to the fuel composition signal lines of the Figure. Such an elaboration is considered to be within the scope of the present invention, and may be implemented as circumstances warrant.

As an example, it may be determined that fuel mixing characteristics in a certain boiler are inefficient for low fuel flow rates, and accordingly that a relatively high percentage of excess air is required to secure complete combustion of the fuel. In this event controller 55 would respond to the lowered fuel flow rates by processing a setpoint reflecting a higher percentage of excess air. Conversely, should the rate of flow, or fuel composition, require less excess air for complete combustion controller 55 would apply to target stage 46 a signal reflecting this demand.

In some cases it may be desirable for the oxygen target stage 46 to provide an indication of a desired target signal in a form which is perceivable by an operator, but without physically coupling a signal into the feedback loop. Accordingly, in FIG. 5 target stage 46 does not apply a target signal to controller 34 but instead to a meter 65. The value exhibited upon the face of the meter corresponds to the proper setpoint given the current fuel flow and composition, to achieve the requisite excess air setting. With this implementation an operator is free to implement the new setpoint, as displayed upon meter 65, by manually adjusting an input to controller 34 or by otherwise varying the nature of the signal transmitted from transducer 22 to the ratio station. This approach, while it lacks the precision and rapid response of a fully automated system, allows an operator to monitor various system parameters and to prevent the modification of a setpoint should the system temperatures, pressures, etc. not seem to warrant the change.

The foregoing operations can readily be performed by various types of equipment familiar to workers in the field. In one embodiment the manipulation of the informational signals may be carried on by a digital computer which corresponds to means 46, 48 of FIGS. 3, 4 and 5. Such a computer may be a large mainframe unit whose primary functions concern the operation or monitoring of industrial processes. Alternatively the regulating means may comprise either so-called minicomputers or analog computing devices. The mode of operation of these devices is determined or programmed in accordance with the present descripton so that the requisite fraction of oxygen may be maintained in response to a measured flow of fuel.

In view of the broad variety of modes of adapting controlling apparatus, it will be understood that the specific details of arranging the mechanism to carry out the described operations will be selected according to the application. Once the desired functions are understood it is a straight forward task to connect the appropriate elements of an analog computing device or implement a program for a digital computer for carrying out the requisite steps.

Figure 5:
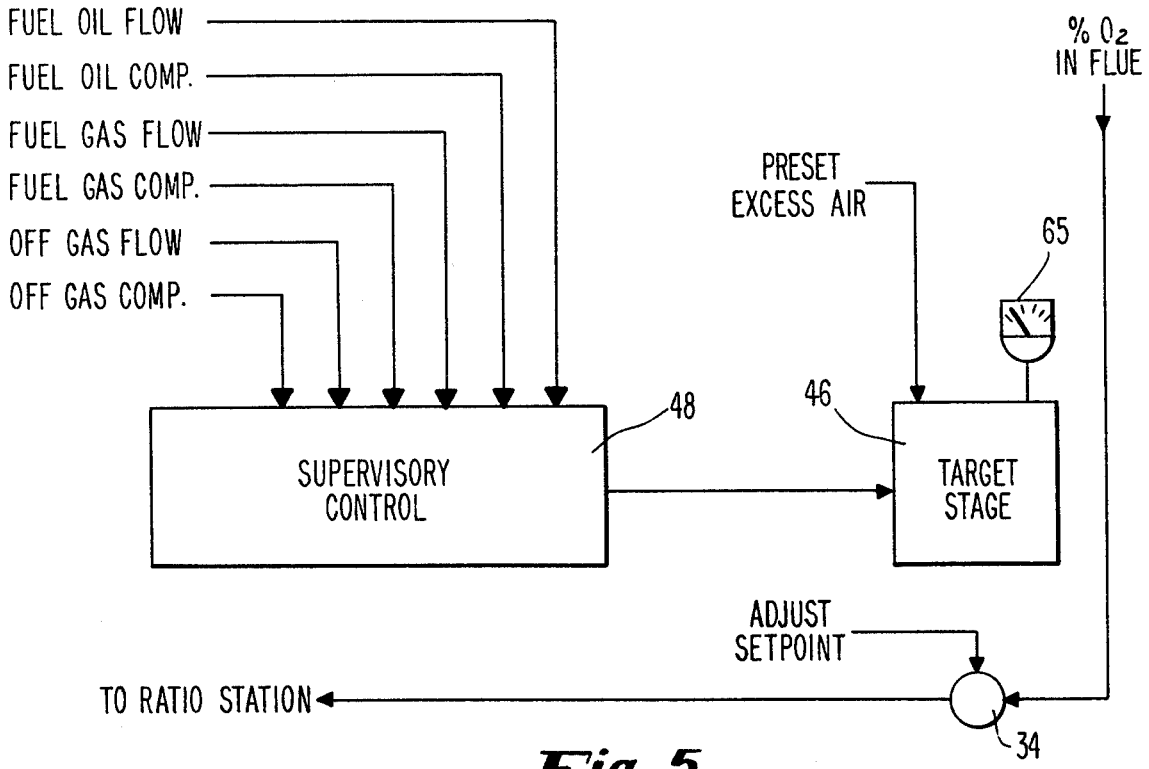
FIG. 5 is another modification of the regulation system of FIG. 3.
Figure 6A:
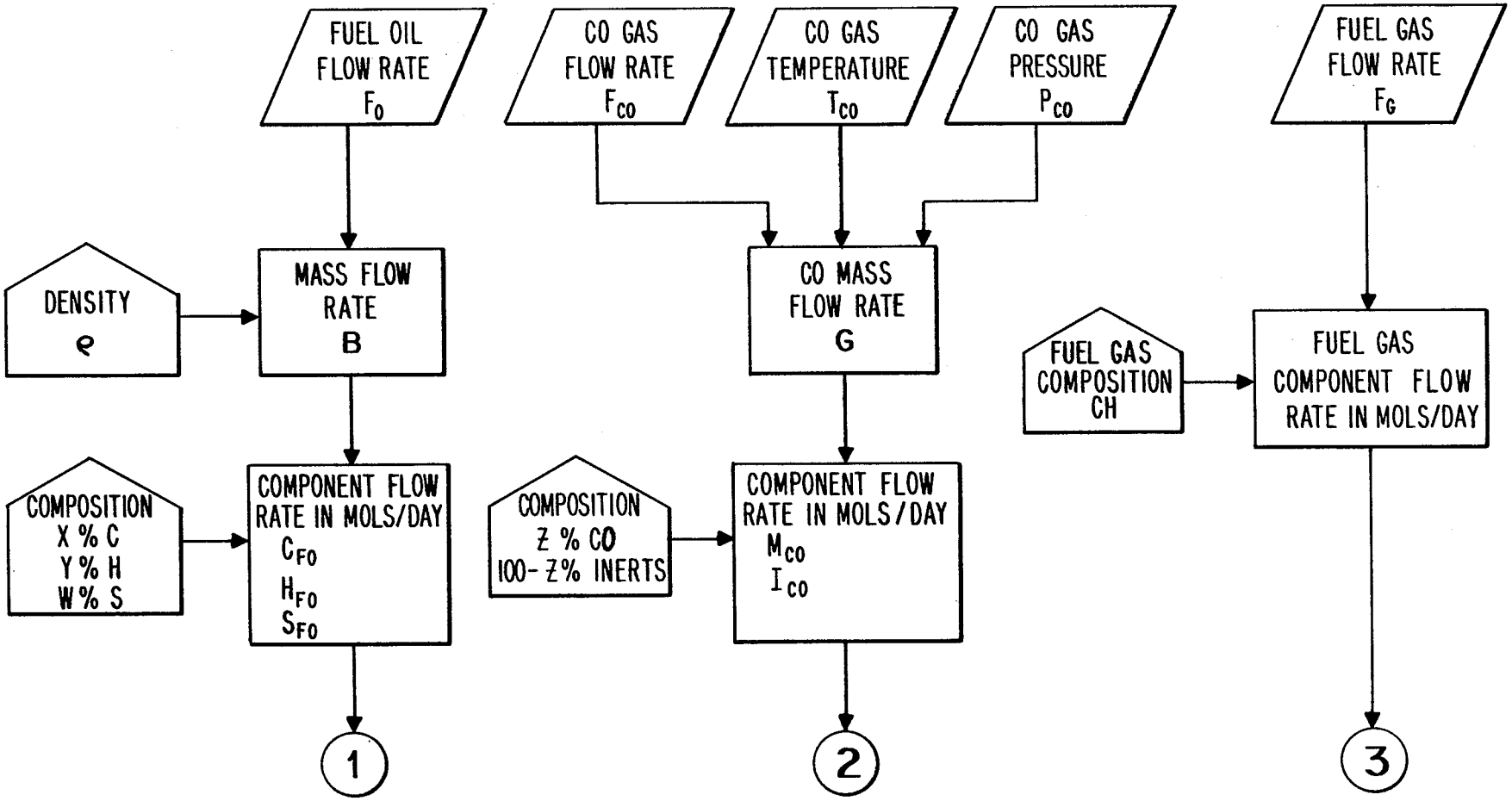
FIGS. 6*a* and 6*b* depict a sequence of operations undertaken by the control system of FIGS. 3, 4 and 5.
Figure 6B:
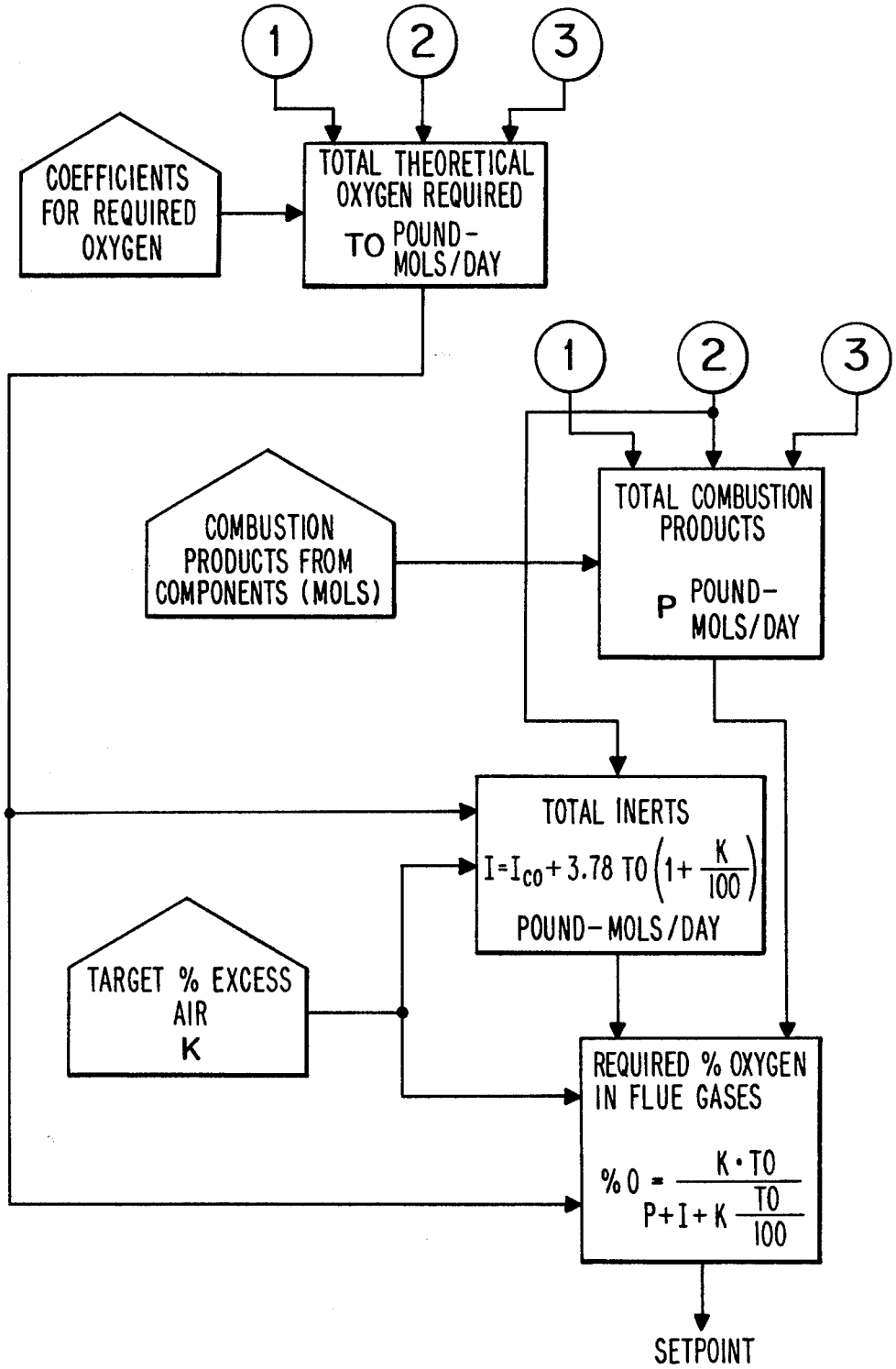

Turning now to FIGS. 6*a* and 6*b* there is shown an idealized flow chart of the process practiced by the apparatus of FIGS. 3, 4 and 5 and of FIG. 7, to be discussed hereinafter. Initially, the mass flow rates of the various fuels are determined. As stated this may be determined through sampling techniques, monitoring instrumentation, or in a preferred embodiment through the use of real-time transducers. With respect to fuel oil, signals representative of volume rate of flow $F_o$ are combined with a representation of density $\rho$ to determine the flow rate in units of, for instance, pounds per day. Subsequently the known percentages of constituents, e.g. carbon, hydrogen and sulphur are used to determine the pound-mols per day flow rate of each.

Also in an initial step flow rates of the constituents of the low heating value fuel, typically carbon monoxide and inert materials, are calculated. The volumetric flow rate $F_{co}$ of the off-gas (low heating value fuel) is determined, along with its temperature and pressure, and the information combined according to standard formulae to determine the flow rate in standard cubic feet per day G. The percentages of the various known constituents are then used to apportion the flow rate into pure carbon monoxide and other, inert materials and convert these into units of pound-mols per day.

Finally, the flow rates of any other auxiliary fuels are calculated in a like manner. For example, the mass rate of flow of a fuel gas $F_g$ is taken, as shown. It is assumed that the figure so arrived at is compensated, if necessary, for pressure and temperature variations. Such variations may be automatically compensated for by a mass rate of flow transducer; or the parameters can be measured separately and appropriate corrections made as illustrated with respect to the determination of the off-gas flow rate. Such measurements and corrections are easily made with state-of-the-art equipment which is commonly available, and a detailed discussion of the appropriate apparatus is not deemed necessary to those skilled in the art.

The composition of fuel gas is estimated, or determined by appropriate means such as a gas chromatograph. By representing composition in terms of mole fractions and combining this information with a known flow rate, a figure representing the flow of fuel gas compounds in pound-mols per day can be arrived at.

The second step is to determine, in relation to fuel mass, the amount of oxygen theoretically needed to burn the fuel materials in the combustion zone of the apparatus. Using molar proportions or other appropriate units, the total theoretical oxygen TO is expressed in a rate such as pound-mols per day. With the latter information, a third computational step may easily be carried out whereby the pound-mols per day of the total combustion products P of the system is ascertained. Inasmuch as the combustion characteristics of the elements of the fuels are well knowm, this is a straightforward operation which requires the association of oxygen units with the already-known fuel constituents using appropriate common units.

Now given a target excess air K of, for example, 20%, the amount of molecular oxygen which will occur in the combustin products is calculated. This information in turn determines the flue gas oxygen setpoint for the system, which is used to determine when the output of a combustion product-sensing transducer corresponds to the presence of 20% excess air for the particular fuel flow which is being sensed.

Figure 7:
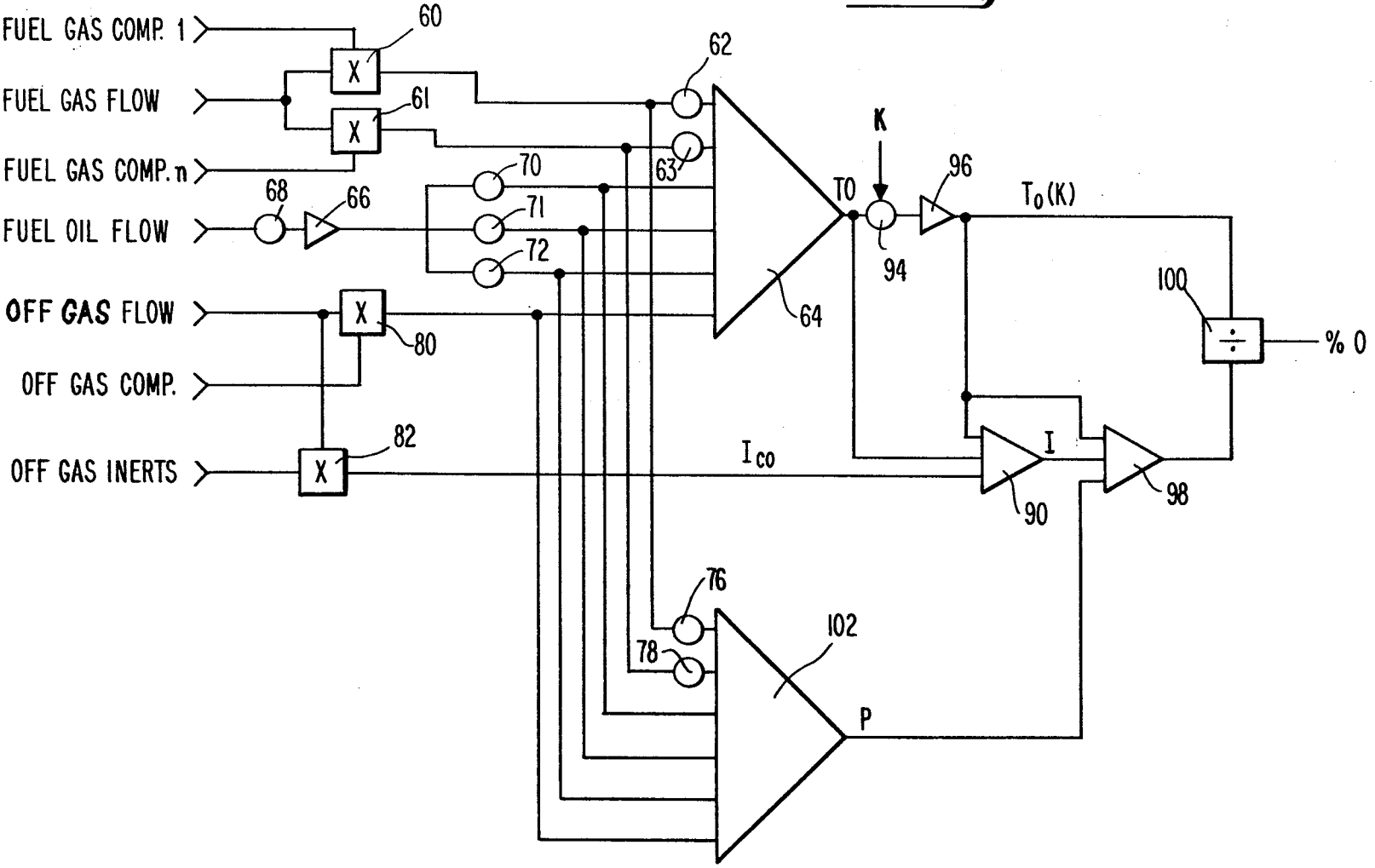
FIG. 7 is a detailed diagram of signal processing apparatus forming the regulation system of the invention.

Turning now to FIG. 7 there is shown a signal processing system constructed of commonly-available elements and operable to carry out the method set forth in FIGS. 6*a*-6*b*. A signal indicating the mass rate of flow of a fuel gas, such as may be derived from transducer 44 of FIG. 3 is applied to a plurality of multiplying stages of which two (60 and 61) are shown. n signals indicating the composition of n fuel gas components are applied to these multipliers. As set forth hereinabove, a signal representing fuel gas composition may be provided by manual adjustment subsequent to the analysis of the fuel in a laboratory; or, in a preferred embodiment an analyzer such as a gas chromatograph is coupled directly to the fuel gas stream and signals indicating composition derived therefrom. In any event, properly-weighted signals are applied to the appropriate number of multiplying stages with the result that signals reflecting the molar rate of flow of certain components of the gas was applied to a first summing stage 64 by way of trimming potentiometers 62 and 63.

A signal representing fuel oil flow is trimmed by a potentiometer 68 and passed through amplifier 66 to a bank of potentiometers of the like 70, 71 and 72. The latter three potentiometers are adjusted to represent the molar amounts of carbon, hydrogen and sulphur in the fuel oil. Summing stage 64 serves to derive the total oxygen TO which is theoretically required to react with the combustible constituents of the various fuels.

Finally, a signal representative of the flow of an off-gas is applied to multiplier stages 80, 82. A signal representing the combustible fraction of the off-gas is also inputted to multiplier stage 80 and a representation of the inert portion of the off-gas is applied to multiplier 82.

The signals applied to first summing stage 64 are also applied to a second summing stage 102 with different gains as appropriate so that summing stage 102 produces a signal representing the flow rate of the total products of combustion. Additional trimming potentiometers 76 and 78 may be connected as shown. The signal produced by multiplier stage 82 outputs a signal $I_{co}$ representing the molar rate of flow of the inert constituents of the off-gas.

The rate of inert flow $I_{co}$ from the off-gas is applied to one input of an operational amplifier 90, along with the signal TO outputted by first summing stage 64. The third input to summing amplifier 90 constitutes a representation of the added excess air which is desired to be supplied to the combustion zone. A potentiometer or the like 94 is varied according to a target excess air percentage signal K. This information may be inputted to the signal manually, such as by adjusting the wiper on a potentiometer; or may constitute a signal from other process control as disclosed in FIG. 5. In any event the theoretical oxygen signal TO is apportioned by element 94 and passed by amplifier 96 to summing amplifiers 90, 98 and to a dividing stage 100.

Summing amplifier 90 produces a signal I indicative of the total required inerts attributable to the off-gas and to the air introduced into the combustion zone (including excess air). This signal along with the corrected theoretical excess oxygen requirement K. TO and a representation P of the products of combustion are coupled to a final summing amplifier 98. The summed signal, along with the target excess oxygen signal, are factored together in dividing stage 100 to produce a setpoint signal representing the target percentage of oxygen which will be found in the flue gases when the desired percentage of excess air is flowing to the combustion zone. This signal, herein denominated % O, may then be applied to a controller such as controller 34 in FIG. 3 to cause a ratio station to vary the flow of air and/or auxiliary fuels to the combustion zone until the requisite percentage of oxygen is sensed in the flue gases.

As will be evident from the foregoing description, certain aspects of the invention are not limited to the particular details of the examples illustrated, and it is therefore contemplated that other modifications or applications will occur to those skilled in the art. Particularly in the area of processing of information in the control system it is believed that various analog and digital systems may be adapted for use, including digital and analog computers along with networks of state-of-the-art control elements. Accordingly, it is intended that the appended claims shall cover all such modifications and applications as do not depart from the true spirit and scope of the invention.

What is claimed as new and desired to be secured by Letters Patent of the United States is:

1. A control system for operating apparatus including a combustion zone and an exhaust flue and operable to derive variable amounts of heat energy from an off-gas fuel having a first heating value and an auxiliary fuel having a second heating value substantially greater than said first heating value, comprising:

sensor means disposed in flow relation with the exhaust flue for identifying the percentage of molecular oxygen in the system exhaust gases and outputting a flue oxygen signal;

first flow rate sensing means disposed in flow relationship with the fuels flowing to the combustion zone for developing signals representing the flow rate of said fuels;

second flow rate sensing means disposed in flow relationship with air flowing to the combustion zone for developing signals representing the flow rate of the air;

analyzing means in flow relationship with said off-gas fuel for outputting signals representing the relative percentages of the constituents of the fuels including the inert constituents of said off-gas fuel;

supervisory control means coupled to said flow rate sensing means and to said analyzing means and responsive to signals representing said flow rates and fuel constituents for outputting a target signal representing the proportion of molecular oxygen in the system exhaust gases which corresponds to the presence of a predetermined proportion of excess air in the combustion zone;

controller means responsive to said sensor means and said supervisory control means for developing a setpoint signal; and a ratio station for controllably varying the relative amounts of fuel and air flowing to the combustion zone in response to the setpoint signal.

2. A control system according to claim 1, wherein said supervisory control means includes means for deriving the total flow of inert materials into the combustion zone including the inert portion of atmospheric air.

3. A control system for operating apparatus including a combustion zone and an exhaust flue and operable to derive variable amounts of heat energy from an off-gas fuel having a first heating value and an auxiliary fuel having a second heating value substantially greater than said first heating value, comprising:

an oxygen sensor disposed in flow relation to the exhaust flue for identifying the percentage of molecular oxygen in the system exhaust gases and outputting a flue oxygen signal;

first flow rate sensing means disposed in flow relationship with fuels flowing to the combustion zone for developing signals representing the flow rates of said off-gas and auxiliary fuels;

second flow rate sensing means disposed in flow relationship with air flowing to the combustion zone for developing signals representing the flow rate of the air;

a supervisory control coupled to said flow rate sensing means for receiving signals representing said flow rates and developing a signal representing the molar flow rate of the oxygen required for complete combustion of said fuels, the total products of combustion, and the inert materials flowing from the combustion zone;

a target stage coupled to said supervisory control for receiving said last-named signals and responsive thereto for outputting a target signal representing the proportion of molecular oxygen in the system exhaust gases which corresponds to the presence of a predetermined proportion of excess air in the combustion zone;

controller means coupled to said oxygen sensor for outputting a setpoint signal reflecting the values of said flue oxygen signal and said target signal; and a ratio station responsive to said setpoint signal for controllably varying the relative amounts of fuel and air flowing to the combustion zone.

4. A control system according to claim 3, further including means coupling said target stage to said ratio station for transmitting said setpoint signal to said ratio station.

5. A control system according to claim 4, wherein said flow rate sensing means develops signals representing the mass flow rates of said fuels.

6. A control system according to claim 5, wherein said flow rate sensing means develops signals representing the mass flow rates of at least some constituents of said fuels.

7. A control system according to claim 6, wherein said means coupling said target stage to said ratio station is the controller means, said controller means being operative to compare a signal from said oxygen sensor means with said target signal to obtain a setpoint signal.

8. A control system according to claim 7, wherein said ratio station is responsive to said setpoint signal to change the ratio of air to fuel in said combustion zone in a manner which lessens said setpoint signal.

9. A control system for operating apparatus including a combustion zone and an exhaust flue and operable to derive variable amounts of heat energy from an off-gas fuel having a first heating value and at least one auxiliary fuel having a second heating value substantially greater than said first heating value, comprising:

sensor means disposed in flow relation to the exhaust flue for identifying the percentage of molecular oxygen in the system exhaust gases;

a ratio station for controllably varying the relative amounts of fuel and air flowing to the combustion zone in response to a setpoint signal;

first flow rate sensing means disposed in flow relationship with fuels flowing to the combustion zone for developing signals representing the flow rates of said fuels;

second flow rate means disposed in flow relationship with air flowing to the combustion zone for developing signals representing the flow rate of the air;

supervisory control means coupled to said flow rate sensing means for receiving signals representing said flow rates and developing a signal representing the molar flow rates of the oxygen required for complete combustion of said fuels, the total products of combustion, and the inert materials flowing from the combustion zone;

a target stage coupled to said supervisory control means for receiving said last-named signals and responsive thereto for outputting a target signal representing the proportion of molecular oxygen in the system exhaust gases which corresponds to the presence of a predetermined proportion of excess air in the combustion zone; and means responsive to said target stage and to said sensor means for applying a setpoint signal to said ratio station for determining the fuel/air ratio to be maintained thereby.

10. A machine process of operating an off-gas combustion system fueled by an off-gas product fuel having a first heating value and at least one auxiliary fuel having a second heating value to maintain a fixed value of excess air input, comprising the steps of:

measuring the flow rate for each fuel and producing signals representative thereof;

measuring the rate of flow of combustion air;

multiplying said signals by selected values to derive a first representation of the total theoretical oxygen required for complete combustion of each fuel;

manipulating said signals to derive a second representation of the total combustion products of the fuels;

manipulating said signals to derive a third representation of the inert components of at least the off-gas product fuel;

associating said representations with a signal which reflects a predetermined percentage of excess air to obtain a setpoint signal representing the proportion of molecular oxygen which occurs in the system exhaust gases when the fuels are burned in the presence of said percentage of excess air; and adjusting the air inflow to the combustion system to achieve said proportion of excess oxygen in the system exhaust gases.

11. A machine-implemented method for operating an off-gas combustion system fueled by an off-gas fuel having a first heating value and at least one auxiliary fuel having a second heating value substantially higher than said first heating value, and comprising the steps of:

measuring the mass flow rate of each fuel;

measuring the rate of flow of combustion air;

determining the mass-mol rate of flow of the combustible constituents of each fuel;

determining the proportion of oxygen required for complete combustion of each fuel;

determining the mass-mol rates of flow for both the inert constituents of at least said off-gas and the oxygen required for combustion;

deriving the proportion of oxygen in the resulting combustion products;

selecting a desired value of excess air to be introduced into the combustion system;

determining the proportion of molecular oxygen which will arise in the exhaust from the combustion system for the selected value of excess air;

sensing the proportion of molecular oxygen actually occurring in the exhaust from the combustion system; and adjusting the flow of air to the combustion system to cause the sensed proportion of molecular oxygen to correspond to the proportion which will arise for the selected value of excess air.

* * * * *